US006966976B1

(12) United States Patent
Mcgraw et al.

(10) Patent No.: US 6,966,976 B1
(45) Date of Patent: Nov. 22, 2005

(54) ELECTROPLATING PANEL WITH PLATING THICKNESS-COMPENSATION STRUCTURES

(75) Inventors: Colin M. Mcgraw, Hutchinson, MN (US); Andrew J. Peltoma, Litchfield, MN (US)

(73) Assignee: Hutchinson Technology Incorporated, Hutchinson, MN (US)

( * ) Notice: Subject to any disclaimer, the term of this patent is extended or adjusted under 35 U.S.C. 154(b) by 206 days.

(21) Appl. No.: 10/337,802

(22) Filed: Jan. 7, 2003

(51) Int. Cl.[7] ..... C25D 17/06
(52) U.S. Cl. ..... 204/297.01; 204/224 R; 204/297.06; 204/DIG. 7
(58) Field of Search ..... 204/224 R, DIG. 7, 204/297.01, 297.06

(56) References Cited

U.S. PATENT DOCUMENTS

| | | | | |
|---|---|---|---|---|
| 3,862,891 | A | 1/1975 | Smith | |
| 3,880,725 | A | 4/1975 | Van Raalte et al. | |
| 4,534,832 | A | 8/1985 | Doiron, Jr. | |
| 4,936,973 | A * | 6/1990 | Coombes, Jr. | 204/297.11 |
| 5,135,636 | A * | 8/1992 | Yee et al. | 205/96 |
| 5,443,707 | A | 8/1995 | Mori | |
| 5,788,829 | A | 8/1998 | Joshi et al. | |
| 5,804,052 | A | 9/1998 | Schneider | |
| 6,027,631 | A | 2/2000 | Broadbent | |
| 6,033,540 | A | 3/2000 | Kosaki et al. | |
| 6,210,554 | B1 | 4/2001 | Kosaki et al. | |
| 6,261,426 | B1 | 7/2001 | Uzoh et al. | |
| 6,267,860 | B1 * | 7/2001 | Brodsky | 205/96 |
| 2001/0054556 | A1 | 12/2001 | Nakamoto et al. | |
| 2002/0079230 | A1 | 6/2002 | Basol et al. | |

* cited by examiner

*Primary Examiner*—Roy King
*Assistant Examiner*—William T. Leader
(74) *Attorney, Agent, or Firm*—Faegre & Benson LLP

(57) ABSTRACT

An electroplating panel having a strip of components to be electroplated. The components are spaced apart from one another along an edge of the strip. The panel includes a main buss and a plating thickness-compensation structure electrically connecting the main buss to the components at the edge of the strip. The plating thickness-compensation structure includes a first buss member and a second buss member. The first buss member extends along the edge of the strip and electrically connected to each component. The second buss member is electrically connected to main buss. The plating thickness-compensation structure further includes one or more links electrically connecting the first and second buss members.

27 Claims, 5 Drawing Sheets

ELECTROPLATING PANEL WITH PLATING THICKNESS-COMPENSATION STRUCTURES

FIELD OF THE INVENTION

The present invention relates to an improved electroplating panel having strips of head suspension components or other components to be electroplated. More particularly, the invention is directed to certain improvements in the construction of the panel to control the thickness of the electroplated metal (e.g. to achieve a relatively uniform plating thickness distribution across the surfaces of the components).

BACKGROUND OF THE INVENTION

Electroplating is a manufacturing technique used in the fabrication of head suspension components or other components with conductive (commonly metal or metal alloy) layers. This technique involves the passage of plating current through an electrolytic solution containing metal ions between two electrodes of a plating power supply (e.g. a battery). The plating current causes an electrochemical reaction on the surface of an electroplating panel having strips of components to be electroplated. This reaction results in deposition of an electroplated metal layer on the surfaces of the components through which the plating current is passed. Generally, in the electroplating process, the thickness profile of the electroplated metal layer is controlled to be as uniform as possible. It is advantageous for the electroplated metal layer to have a uniform or flat thickness profile across the surfaces of the components.

Nevertheless, the conventional electroplating techniques are susceptible to relatively non-uniform thickness profile variations. Such variations are due to relatively non-uniform plating current distribution over the surfaces of the components.

FIG. 1 is a schematic view of a prior art electroplating panel 30 having several strips 32 of components 34 to be electroplated. FIG. 1 primarily shows electrical features (e.g. the conductive metal) of the electroplating panel 30. Each strip 32 of the components 34 extends between the opposite borders 40 of the panel 30. Each strip 32 also includes an edge portion 36 extending between the opposite borders 40. The components 34 are spaced apart from one another along the edge portion 36.

The panel 30 further includes a main buss 38 extending along the opposite borders 40 of the panel. Each strip 32 has an associated strip buss 42 extending along the edge portion 36 of the strip 32. The strip buss 42 has two opposite ends 44 and 46 electrically connected to the main buss 38, respectively. The strip busses 42 are also electrically connected to each of the components 34 to be electroplated on the associated strip 32.

During the electroplating process, the panel 30 is immersed into an electrolytic solution. When a voltage is applied from a plating power supply, the plating current flows through the electrolytic solution and the panel 30. The amount of metal plated on the components 34 depends on the distribution of plating current density on each strip 32 of the panel 30.

In the illustrated prior art embodiment, the ohmic resistance of the strip buss 42 and the components 34 on the strip 32 gradually increases from the opposite ends 44 and 46 toward the middle point 33 of the strip buss 42. Such resistance contributes to plating current density drop from the opposite ends 44 and 46 to the middle point 33 of the strip buss 42. Consequently, the plating current density on the strip 32 varies somewhat (i.e. tends to be higher at two opposite ends 43 and 45 of the strip 32). As a result, the plating rate tends to be substantially greater at the opposite ends 43 and 45 of the strip 32 relative to the interior of the strip 32. Because of this relatively non-uniform plating rate, the final electroplated metal layer on the strip 32 tends to have a "dish" type pattern (i.e. thicker at the opposite ends 43 and 45 of the strip 32 and thinner at the center of the strip 32).

There are two electrical contacts on each panel. If a strip on the panel is closer to the electrical contacts than other strips, the electroplated metal layer on this strip tends to have a thicker "dish" type pattern. The electroplated metal layer on the strip that is closest to the electrical contacts tends to have the thickest "dish" type pattern.

It would be desirable to control the thickness profile of the electroplated metal layer to compensate for the relative non-uniformity that can arise in the electroplating process. A number of electroplating devices and methods directed to improvements of plating thickness distribution are described, for example, in U.S. Pat. Nos. 3,862,891, 3,880,725, 4,534,832, 5,443,707, 5,788,829, 5,804,052, 6,027,631, 6,033,540, 6,210,554, 6,261,426, and 6,267,860 as well as in U.S. Pub. Nos. 2001/0054556 and 2002/0079230. However, there is a continuing need for apparatus and methods that can control the thickness of the electroplated metal layer to a desired profile of uniformity in panels having strips of components.

SUMMARY OF THE INVENTION

The present invention is directed to a panel having a strip of head suspension components or other components to be electroplated. The components are spaced apart from one another along an edge of the strip. The panel includes a main buss and a plating thickness-compensation structure electrically connecting the main buss to the components at the edge of the strip.

In one embodiment of the invention, the plating thickness-compensation structure includes a first buss member and a second buss member. The first buss member extends along the edge of the strip and is electrically connected to each component. The second buss member is electrically connected to the main buss. The plating thickness-compensation structure also includes one or more links electrically connecting the first and second buss members.

In one embodiment of the present invention, the plating thickness-compensation structure includes a single link generally midway between the opposite ends of the first buss member. The link electrically connects the first and second buss members. In another embodiment of the present invention, the plating thickness-compensation structure includes a plurality of links generally symmetrically spaced between the opposite ends of the first buss member with respect to a middle point of the first buss member. The plating thickness-compensation structure preferably distributes plating current from the main buss to the components in such a manner as to cause a relatively uniform plating thickness distribution across surfaces of the components.

DETAILED DESCRIPTION OF THE INVENTION

Figure 1:
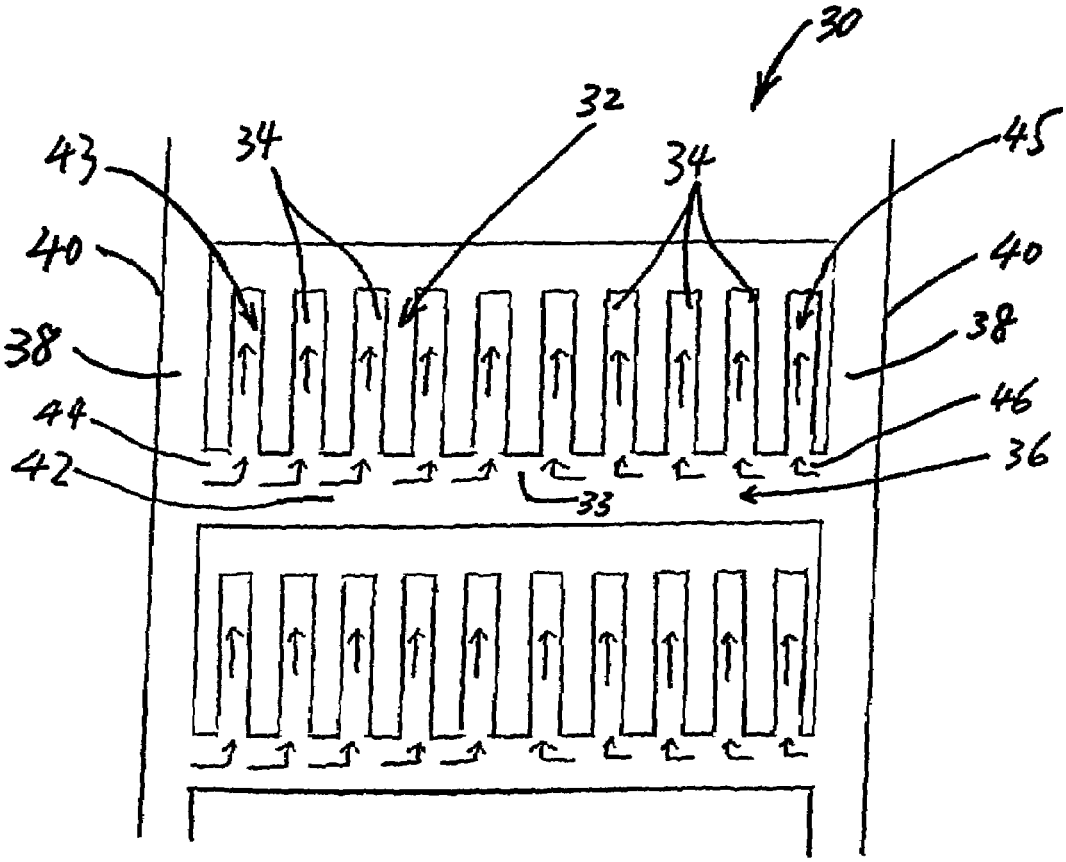
FIG. 1 Prior Art
FIG. 1 is a schematic view of a prior art electroplating panel having strips of components to be electroplated.
Figure 2:
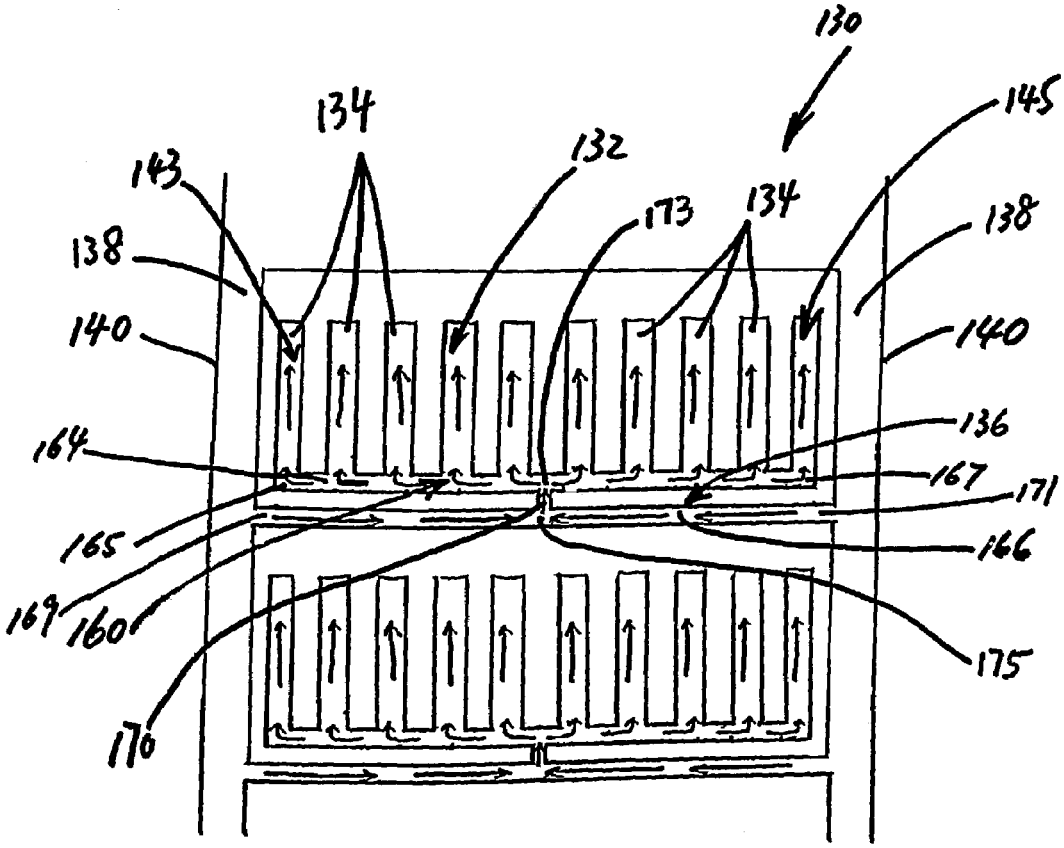
FIG. 2 is a schematic view of an electroplating panel including a plating thickness-compensation structure in accordance with the present invention.

FIG. 2 is a schematic view of an electroplating panel 130 having strips 132 of head suspension components (such as integrated lead or wireless flexures) or other components 134 to be electroplated. FIG. 2 primarily shows electrical features of the panel 130 (i.e., metal busses and integrated leads on head suspension flexures). Each strip 132 of the components 134 extends between the opposite borders 140 of the panel 130. Each strip 132 also includes an edge portion 136 extending between the opposite borders 140. The components 134 are spaced apart from one another along the edge portion 136.

The panel 130 further includes a main buss 138 extending along borders 140 of the panel 130. Each strip 132 includes a plating thickness-compensation structure 160 electrically connecting the main buss 138 to the components 134. As used herein, the "plating thickness-compensation structure" refers to a configuration or structure in an electroplating panel that controls uniformity of thickness profile of an electroplated metal on the components on the panel. The plating thickness-compensation structure 160 includes a plating current distribution configuration for distributing plating current to each of the components 134 along the edge portion 136 of the strip 132 to achieve a desired plating thickness distribution across the surfaces of the components 134.

The plating thickness-compensation structure 160 includes a first buss member 164 and a second buss member 166. The first buss member 164 extends along the edge portion 136 of the strip 132. The first buss member 164 is isolated from the main buss 138 (except through the second buss member 166 as described below) and is electrically connected, along the edge portion 136, to each of the components 134 to be electroplated. The first buss member 164 has a uniform dimension between its two opposite ends 165 and 167 in the illustrated embodiment.

The second buss member 166 of the plating thickness-compensation structure 160 is generally parallel to the first buss member 164. The second buss member 166 has two opposite ends 169 and 171 electrically connected to the main buss 138, respectively. The second buss member 166 has a uniform dimension between its two opposite ends 169 and 171 in the illustrated embodiment. The dimensions of the second buss member 166 may or may not be equal to the dimensions of the first buss member 164.

The plating thickness-compensation structure 160 in the illustrated embodiment further includes a single link 170 electrically connecting the first buss member 164 and second buss member 166. In the illustrated embodiment, the link 170 electrically connects the middle point 173 of the first buss member 164 and the middle point 175 of the second buss member 166. In other words, the link 170 is midway between the two opposite ends 165 and 167 of the first buss member 164. The link 170 does not need to be midway between the two opposite ends 165 and 167 of the first buss member 164. The location of the link 170 can be shifted away from the middle points of the buss members.

During the plating process, the panel 130 is immersed into an electrolytic solution. When a voltage is applied from a plating power supply, the plating current flows through the electrolytic solution and the panel 130. The amount of metal plated on the components 134 depends on the distribution of plating current density on each strip 132 of the panel 130. The plating current flows from the main buss 138 to the second buss member 166, and then to the first buss member 164. Before reaching the first buss member 164, the plating current has to pass through the link 170 that electrically connects the first and second buss members 164 and 166. The plating current further reaches the components 134 electrically connected to the first buss member 164.

Unlike the distribution of the plating current on the prior art electroplating panel 30 described above, the plating current density on the strip 132 does not tend to be substantially higher at the two opposite ends 143 and 145 of the strip 132. Consequently, the electroplating rate does not tend to be substantially greater at the opposite ends 143 and 145 of the strip 132 relative to the interior of the strip 132. Since the electroplating rate on the strip 132 can be controlled, a desired plating thickness distribution across the surfaces of the components 134 on the strip 132 of the panel 130 can be achieved.

Further, the dimensions and the locations of the links on different strips can be different. Accordingly, if a strip on the panel is closer to electrical contacts than other strips, the thickness of the electroplated metal layer on this strip can be adjusted to be substantially the same as those of other strips.

Figure 3:
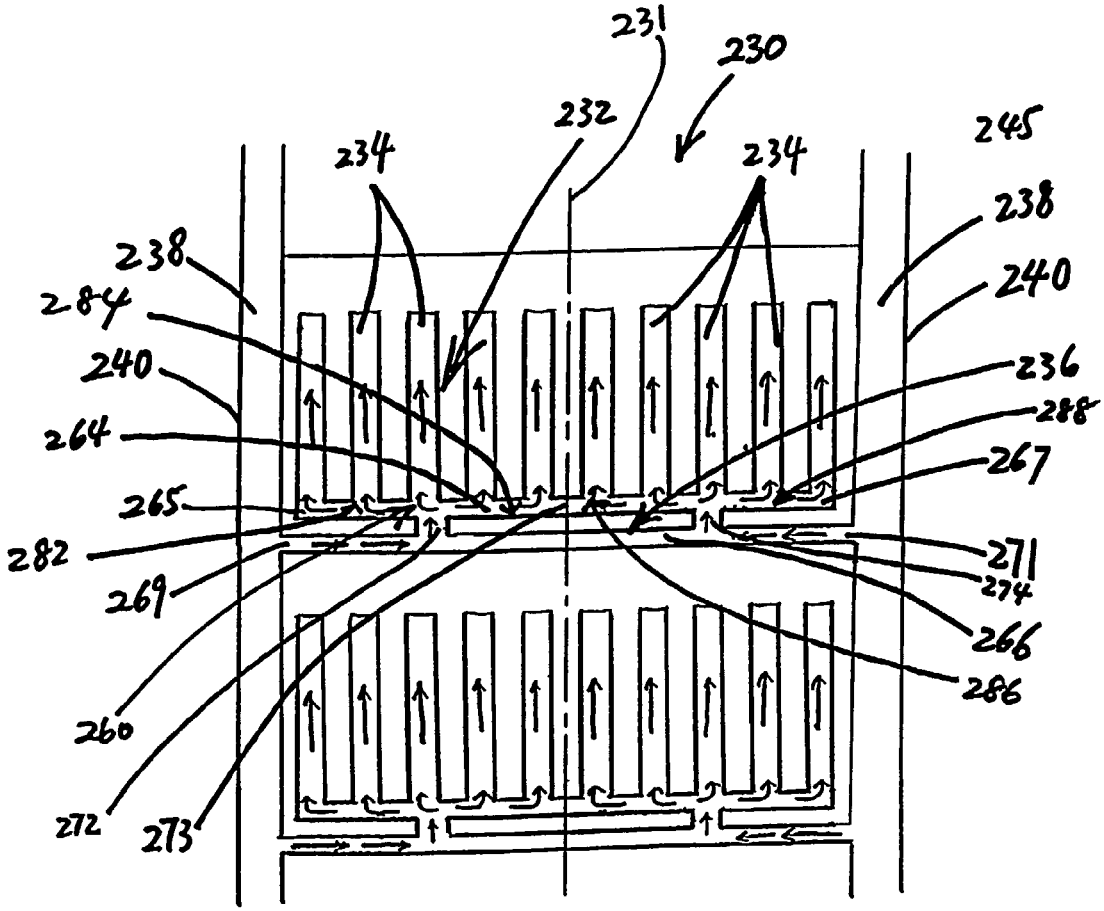
FIG. 3 is a schematic view of an electroplating panel including a second embodiment of a plating thickness-compensation structure in accordance with the present invention.

FIG. 3 is a schematic view of an electroplating panel 230 including a second embodiment of a plating thickness-compensation structure in accordance with the present invention. The panel 230 has strips 232 of head suspension components or other components 234 to be electroplated. FIG. 3 primarily shows electrical features of the panel 230 (i.e., metal busses and integrated leads on head suspension flexures). Each strip 232 of the components 234 extends between the opposite borders 240 of the panel 230. Each strip 232 also includes an edge portion 236 extending between the opposite borders 240. The components 234 are spaced apart from one another along the edge portion 236. The panel 230 has a main buss 238 extending along borders 240 of the panel 230. The panel 230 includes a second embodiment of a plating thickness-compensation structure 260 in accordance with the present invention. The plating thickness-compensation structure 260 includes a plating current distribution configuration for distributing plating current to each of the components 234 along the edge portion 236 of the strip 232 to achieve a desired plating thickness distribution across the surfaces of the components 234.

The plating thickness-compensation structure 260 includes a first buss member 264 and a second buss member 266. The first buss member 264 extends along the edge portion 236 of the strip 232. The first buss member 264 is isolated from the main buss 238 and is electrically connected, along the edge portion 236, to each of the components 234 to be electroplated. The first buss member 264 has a uniform dimension between its two opposite ends 265 and 267 in the illustrated embodiment.

The second buss member 266 of the plating thickness-compensation structure 260 is generally parallel to the first buss member 264. The second buss member 266 has two opposite ends 269 and 271 electrically connected to the main buss 238, respectively. The second buss member 266 has a uniform dimension between its two opposite ends 269 and 271 in the illustrated embodiment. The dimensions of the second buss member 266 may or may not be equal to the dimensions of the first buss member 264.

The plating thickness-compensation structure 260 in the illustrated embodiment further includes a first link 272 and a second link 274 electrically connecting the first buss member 164 and second buss member 166, respectively. The first and second links 272 and 274 are symmetric with respect to a centerline 231 of the strip 232. The first link 272 is located midway between the first end 265 of the first buss member 264 and the middle point 273 of the first buss member 264. Likewise, the second link 274 is located midway between the second end 267 of the first buss member 264 and the middle point 273 of the first buss member 264.

The first link 272 does not need to be midway between the first end 265 of the first buss member 264 and the middle point 273 of the first buss member 264. Likewise, the second link 274 does not need to be midway between the second end 267 of the first buss member 264 and the middle point 273 of the first buss member 264. The first and second links 272 and 274 do not need to be symmetric with respect to the centerline 231 of the strip 232. The plating thickness-compensation structure 260 can also be configured in other manners to achieve the desired current distribution.

During the plating process, the panel 230 is immersed into an electrolytic solution. When a voltage is applied from a plating power supply, the plating current flows through the electrolytic solution and the panel 230. The amount of metal plated on the components 234 depends on the distribution of plating current density on each strip 232 of the panel 230. The plating current flows from the main buss 238 to the second buss member 266, and then to the first buss member 264. Before reaching the first buss member 264, the plating current has to pass through the first and second links 272 and 274 that electrically connect the first and second buss members 264 and 266, respectively. The plating current further reaches the components 234 electrically connected to the first buss member 264.

The first buss member 264 in the illustrated embodiment includes four elongated portions 282, 284, 286, and 288. The first elongated portion 282 extends between the first end 265 of the first buss member 264 and the first link 272. The second elongated portion 284 extends between the first link 272 and the middle point 273 of the first buss member 264. The third elongated portion 286 extends between the middle point 273 of the first buss member 264 and the second link 274. The fourth elongated portion 288 extends between the second link 274 and the second end 267 of the first buss member 264. The lengths of these four elongated portions 282, 284, 286, and 288 are substantially equal. Consequently, the distributions of the plating current density on the components 234 connected to each of these four elongated portions 282, 284, 286, and 288 are substantially the same. As a result, the thickness of the electroplated metal layer on the components 234 can be controlled to provide a relatively uniform profile. A relatively uniform plating thickness distribution across the surfaces of the components 234 on the strip 232 of the panel 230 can thus be achieved.

The lengths of these four elongated portions 282, 284, 286, and 288 do not need to be substantially equal. The lengths can be varied to achieve desired plating current distribution patterns.

The plating thickness-compensation structure may include more than two links electrically connecting the first and second buss members. These links may or may not be symmetric with respect to a centerline of the strip. In addition, the dimensions and/or locations of the links can be modified to achieve desired plating current distribution patterns.

The dimensions of the first and second buss members can be modified to adjust the ohmic resistance of the electroplated metal layer on the busses. As a result, plating current density on the components can be controlled, and a desired plating thickness distribution across the surfaces of components can be achieved.

Further, the number, the dimensions, and the locations of the links on different strips can be different. Accordingly, if a strip on the panel is closer to electrical contacts than other strips, the thickness of the electroplated metal layer on this strip can be adjusted to be substantially the same as those of other strips.

Figure 4:
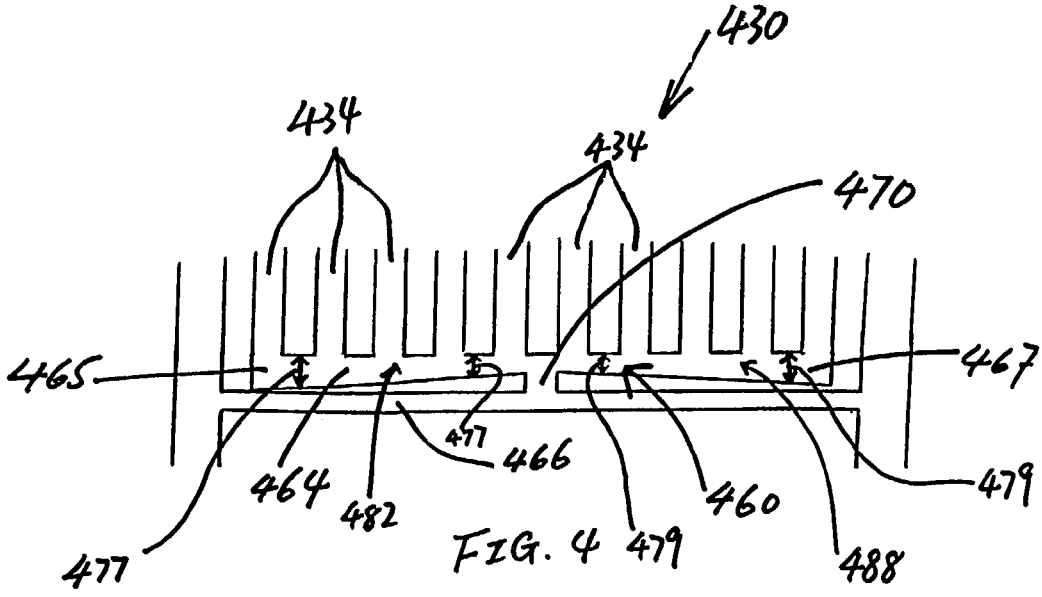
FIG. 4 is a schematic view of an electroplating panel including a third embodiment of a plating thickness-compensation structure in accordance with the present invention.

The dimensions of the first buss member of the plating thickness-compensation structure do not need to be uniform between its two opposite ends. FIG. 4 is a schematic view of an electroplating panel 430 including a third embodiment of a plating thickness-compensation structure 460 in accordance with the present invention. FIG. 4 primarily shows electrical features of the panel 430 (i.e., metal busses and integrated leads on head suspension flexures). The plating thickness-compensation structure 460 includes a first buss member 464 and a second buss member 466.

In the illustrated embodiment, the plating thickness-compensation structure 460 has a single link 470 midway between the opposite ends 465 and 467 of the first buss member 464. The first buss member 464 includes two elongated portions 482 and 488. The first elongated portion 482 extends between the first end 465 of the first buss member 464 and the link 470. The first elongated portion 482 has a tapered width 477 such that the width 477 decreases from the first end 465 toward the link 470. The second elongated portion 488 extends between the second end 467 of the first buss member 464 and the link 470. The second elongated portion 488 has a tapered width 479 such that the width 479 decreases from the second end 467 toward the link 470. The dimensions of the first and second elongated portions 482 and 488 are symmetric with respect to the link 470. As a result, the plating current distribution along the first buss member 464 can be controlled to a desired pattern, and a desired plating thickness distribution across the surfaces of components 434 can be achieved.

Figure 5:
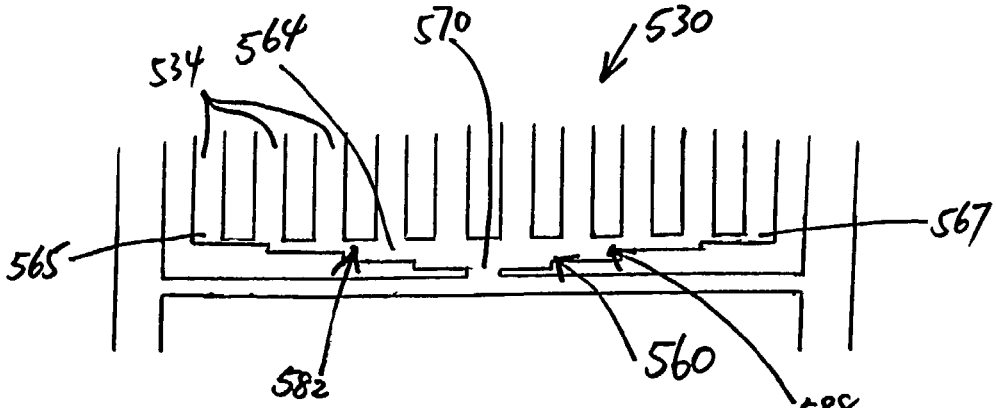
FIG. 5 is a schematic view of an electroplating panel including a fourth embodiment of a plating thickness-compensation structure in accordance with the present invention.

FIG. 5 is a schematic view of an electroplating panel 530 including a fourth embodiment of a plating thickness-compensation structure 560 in accordance with the present invention. FIG. 5 primarily shows electrical features of the panel 530 (i.e., metal busses and integrated leads on head suspension flexures). The structure of the plating thickness-compensation structure 560 is similar to that of the plating thickness-compensation structure 460 shown in FIG. 4, except for the shape of the first buss member 564. The first elongated portion 582 that extends between the first end 565 and the link 570 has a stepped shape. Similarly, the second elongated portion 588 that extends between the second end 567 and the link 570 also has a stepped shape. The dimensions of the first and second elongated portions 582 and 588 are symmetric with respect to the link 570. Consequently, the plating current distribution along the first buss member 564 can be controlled to a desired pattern, and a desired plating thickness distribution across the surfaces of components 534 can be achieved.

Figure 6:
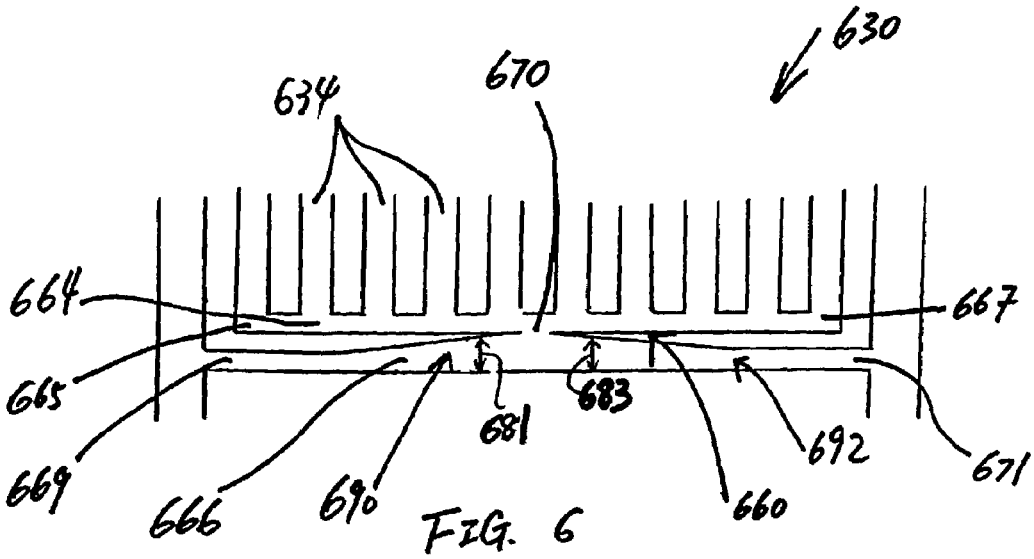
FIG. 6 is a schematic view of an electroplating panel including a fifth embodiment of a plating thickness-compensation structure in accordance with the present invention.

The dimensions of the second buss member do not need to be uniform between its two opposite ends. FIG. 6 is a schematic view of an electroplating panel 630 including a fifth embodiment of a plating thickness-compensation structure 660 in accordance with the present invention. FIG. 6 primarily shows electrical features of the panel 630 (i.e., metal busses and integrated leads on head suspension flexures). The plating thickness-compensation structure 660 includes a first buss member 664 and a second buss member 666.

In the illustrated embodiment, the plating thickness-compensation structure 660 has a single link 670 midway between the opposite ends 665 and 667 of the first buss member 664. The second buss member 666 includes two elongated portions 690 and 692. The first elongated portion 690 extends between the first end 669 of the second buss member 666 and the link 670. The first elongated portion 690 is partially uniform and partially tapered. The uniform portion is near the first end 669. The width 681 of the tapered portion decreases from the link 670. The second elongated portion 692 extends between the second end 671 of the second buss member 666 and the link 670. The second elongated portion 692 is also partially uniform and partially tapered. The uniform portion is near the second end 671. The width 683 of the tapered portion decreases from the link 670. The dimensions of the first and second elongated portions 690 and 692 are symmetric with respect to the link 670. As a result, the plating current distribution can be controlled to a desired pattern, and a desired plating thickness distribution across the surfaces of components 634 can be achieved.

Figure 7:
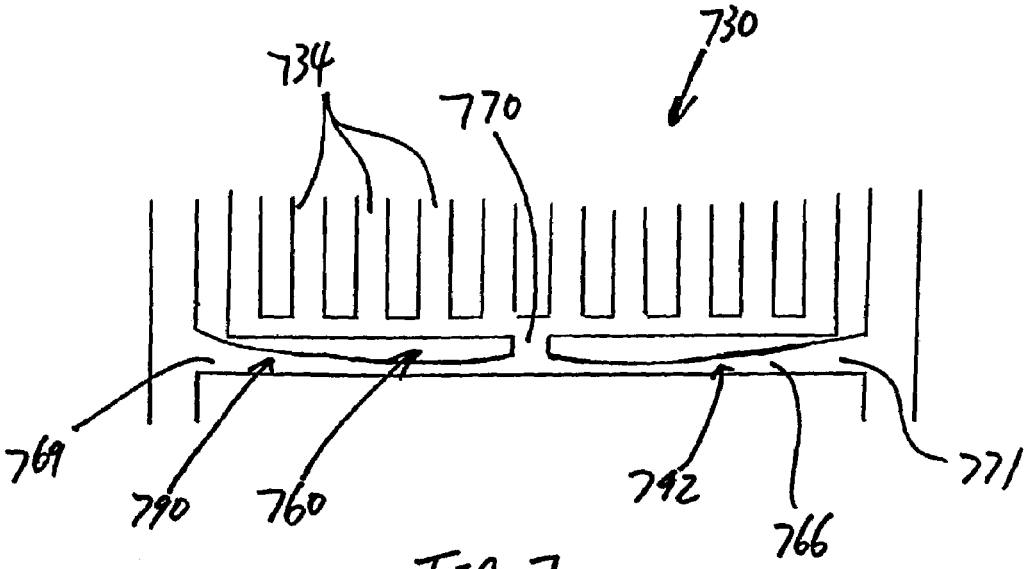
FIG. 7 is a schematic view of an electroplating panel including a sixth embodiment of a plating thickness-compensation structure in accordance with the present invention.

FIG. 7 is a schematic view of an electroplating panel 730 including a sixth embodiment of a plating thickness-compensation structure 760 in accordance with the present invention. FIG. 7 primarily shows electrical features of the panel 730 (i.e., metal busses and integrated leads on head suspension flexures). The structure of the plating thickness-compensation structure 760 is similar to that of the plating thickness-compensation structure 660 shown in FIG. 6, except for the shape of the second buss member 766. The first elongated portion 790 that extends between the first end 769 and the link 770 is curvelinear with wider widths near the first end 769 and the link 770. Similarly, the second elongated portion 792 that extends between the second end 771 and the link 770 is also curvelinear with wider widths near the second end 771 and the link 770. The dimensions of the first and second elongated portions 790 and 792 are symmetric with respect to the link 770. Consequently, the plating current distribution can be controlled to a desired pattern, and a desired plating thickness distribution across the surfaces of components 734 can be achieved.

In FIGS. 4 and 5, the dimensions of the first buss members are non-uniform, while the dimensions of the second buss members are uniform. In FIGS. 6 and 7, the dimensions of the second buss members are non-uniform, while the dimensions of the first buss members are uniform. In an alternative embodiment, both the dimensions of the first buss member and the dimensions of the second buss member can be non-uniform.

The location of the link can be shifted away from the middle point of the first buss member. The dimensions of the first and second elongated portions of the first buss member do not need to be symmetric with respect to the link. The dimensions of the two elongated portions of the first buss member can be different. Likewise, the dimensions of the first and second elongated portions of the second buss member do not need to be symmetric with respect to the link. The dimensions of the two elongated portions of the second buss member can also be different. Moreover, the plating thickness-compensation structures of FIGS. 4–7 may include two or more links.

Further, the number, the dimensions, and the locations of the links on different strips can be different. The shapes of the buss members on different strips can also be different. Accordingly, if a strip on the panel is closer to electrical contacts than other strips, the thickness of the electroplated metal layer on this strip can be adjusted to be substantially the same as those of other strips.

All patents and patent applications disclosed herein, including those disclosed in the background of the invention, are hereby incorporated by reference. Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

We claim:

1. An electroplating panel comprising:

a strip of components to be electroplated, the components spaced apart from one another along an edge of the strip;

a first buss member extending along the edge of the strip of components and electrically connected to the components;

a main buss; and a plating thickness-compensation structure, including one or more links electrically connecting the main buss to the first buss member, to cause a relatively uniform plating thickness distribution across surfaces of the components.

2. The panel of claim 1 wherein the plating thickness-compensation structure includes a plating current distribution configuration for relatively uniform distribution of plating current from the main buss to the components along the edge of the strip.

3. The panel of claim 1 wherein:

the plating thickness-compensation structure includes the first buss member;

the plating thickness-compensation structure includes a second buss member electrically connected to the main buss; and the one or more links electrically connect the first and second buss members.

4. The panel of claim 3 wherein:

the first buss member includes an elongated member; and the second buss member includes an elongated member adjacent to the elongated member of the first buss member and electrically connected at its opposite ends to the main buss.

5. The panel of claim 3 wherein the first buss member has a generally uniform dimension between its opposite ends.

6. The panel of claim 3 wherein the second buss member has a generally uniform dimension between its opposite ends.

7. The panel of claim 3 wherein the first and second buss members both have generally uniform dimensions between their opposite ends.

8. The panel of claim 3 wherein the one or more links of the plating thickness-compensation structure includes a single link between the opposite ends of the first buss member.

9. The panel of claim 8 wherein the single link is generally midway between the opposite ends of the first buss member.

10. The panel of claim 3 wherein the one or more links of the plating thickness-compensation structure includes a plurality of links generally symmetrically spaced between the opposite ends of the first buss member with respect to a centerline of the strip.

11. The panel of claim 3 wherein the one or more links of the plating thickness-compensation structure includes a plurality of links asymmetrically spaced between the opposite ends of the first buss member with respect to a centerline of the strip.

12. The panel of claim 3 wherein the first buss member has non-uniform dimensions between its opposite ends.

13. The panel of claim 3 wherein the second buss member has non-uniform dimensions between its opposite ends.

14. The panel of claim 3 wherein the first and second buss members both have non-uniform dimensions between their opposite ends.

15. The panel of claim 3 wherein the first buss member is linear.

16. The panel of claim 3 wherein the second buss member is linear.

17. The panel of claim 3 wherein the first buss member is curvelinear.

18. The panel of claim 3 wherein the second buss member is curvelinear.

19. The panel of claim 3 wherein the dimensions of the first buss member are symmetric with respect to the links.

20. The panel of claim 3 wherein the dimensions of the first buss member are asymmetric with respect to the links.

21. The panel of claim 3 wherein the dimensions of the second buss member are symmetric with respect to the links.

22. The panel of claim 3 wherein the dimensions of the second buss member are asymmetric with respect to the links.

23. An electroplating panel comprising:

at least one strip including a plurality of components to be electroplated;

a main buss on borders of the panel;

a first buss member having two opposite ends and positioned along an edge of the strip, the first buss member isolated from the main buss and electrically connected to the parts to be electroplated;

a second buss member adjacent and generally parallel to the first buss member, the second buss member having two opposite ends both electrically connected to the main buss; and at least one link electrically connecting the first buss member and the second buss member.

24. The electroplating panel of claim 23 wherein at least one link of the electroplating panel includes a single link between the two opposite ends of the first buss member.

25. The electroplating panel of claim 24 wherein the single link is generally midway between the two opposite ends of the first buss member.

26. The electroplating panel of claim 23 wherein at least one link of the electroplating panel includes two or more links that are generally symmetric with respect to a centerline of the strip.

27. The electroplating panel of claim 23 wherein at least one link of the electroplating panel includes two or more links that are asymmetric with respect to a centerline of the strip.

* * * * *